US008948680B2

(12) United States Patent
Nishimura

(10) Patent No.: US 8,948,680 B2
(45) Date of Patent: Feb. 3, 2015

(54) IMAGE FORMING APPARATUS

(71) Applicant: Brother Kogyo Kabushiki Kaisha, Nagoya-shi, Aichi-ken (JP)

(72) Inventor: Yohei Nishimura, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/851,029

(22) Filed: Mar. 26, 2013

(65) Prior Publication Data

US 2013/0322945 A1 Dec. 5, 2013

(30) Foreign Application Priority Data

May 29, 2012 (JP) ..... 2012-121435

(51) Int. Cl.
*G03G 15/00* (2006.01)
*G03G 21/16* (2006.01)

(52) U.S. Cl.
CPC ..... *G03G 15/6558* (2013.01); *G03G 21/1619* (2013.01); *G03G 21/1647* (2013.01); *G03G 21/168* (2013.01); *G03G 2221/169* (2013.01)
USPC ..... 399/395; 399/110

(58) Field of Classification Search
CPC ..... G03G 21/168; G03G 21/1647
USPC ..... 399/395
See application file for complete search history.

(56) References Cited

U.S. PATENT DOCUMENTS

| | | | | |
|---|---|---|---|---|
| 7,783,227 | B2 * | 8/2010 | Sugimoto | 399/111 |
| 7,871,067 | B2 * | 1/2011 | Lim | 271/9.13 |
| 7,894,743 | B2 * | 2/2011 | Tomatsu | 399/107 |
| 8,180,249 | B2 * | 5/2012 | Okaji | 399/110 |
| 2005/0008393 | A1 * | 1/2005 | Kuma et al. | 399/110 |
| 2006/0193656 | A1 * | 8/2006 | Kumazawa | 399/121 |
| 2007/0160383 | A1 * | 7/2007 | Matsumoto et al. | 399/110 |
| 2008/0193162 | A1 * | 8/2008 | Yamazoe et al. | 399/121 |
| 2010/0019443 | A1 | 1/2010 | Ichikawa | |
| 2012/0033989 | A1 * | 2/2012 | Kuruma et al. | 399/107 |

FOREIGN PATENT DOCUMENTS

| | | |
|---|---|---|
| JP | 2004-302375 A | 10/2004 |
| JP | 2010-052423 A | 3/2010 |

* cited by examiner

*Primary Examiner* — Anthony Nguyen
(74) *Attorney, Agent, or Firm* — Merchant & Gould PC

(57) ABSTRACT

There is provided an image forming apparatus including: a sheet feeding unit; photoconductors; a transfer belt unit; a first and second frame units; and a bridging member bridging the first and second frame units. Each of the photoconductors is held by the first and second frame units. The transfer belt unit is biased to the one end side in the width direction to abut on the first frame unit and the bridging member, to thereby be positioned with respect to the first frame unit and the bridging member. The sheet feeding unit abuts on at least two places, of the bridging member, in the width direction from a perpendicular direction, to thereby be positioned with respect to the bridging member.

6 Claims, 8 Drawing Sheets

IMAGE FORMING APPARATUS

CROSS REFERENCE TO RELATED APPLICATION

The present invention claims priority from Japanese Patent Application No. 2012-121435, filed on May 29, 2012, the disclosure of which is incorporated herein by reference in its entirety.

BACKGROUND OF THE INVENTION

1. Field of the Invention

The present invention relates to an image forming apparatus.

2. Description of the Related Art

A conventional image forming apparatus includes: a paper feeding unit transporting a sheet; a plurality of photoconductors capable of carrying a toner image thereon; a transfer belt unit having a transfer belt which has a transporting surface facing each of the photoconductors and circulates; and a pair of metal frames facing each other in a width direction parallel to rotational centers of the photoconductors.

Each of the photoconductors and the transfer belt unit are located between both the metal frames. One end of the paper feeding unit in the width direction is screwed to a front end edge of the one metal frame, and the other end of the paper feeding unit in the width direction is screwed to a front end edge of the other metal frame, and thereby the paper feeding unit is positioned relative to both the metal frames.

In this image forming apparatus, when the paper feeding unit transports a sheet and the sheet passes through on the transporting surface, each of the photoconductors rotates while making a contact with the sheet. Then, the transfer belt transfers the toner image carried on each of the photoconductors onto the sheet being transported. As above, this image forming apparatus forms an image on the sheet.

SUMMARY OF THE INVENTION

Incidentally, in the above-described conventional image forming apparatus, there is considered a case that positioning accuracy of the transfer belt unit relative to each of the photoconductors and positioning accuracy of the paper feeding unit relative to each of the photoconductors and the transfer belt unit are not adequate. In such a case, the paper feeding unit and the transfer belt unit incline relative to the rotational center of each of the photoconductors, and when the sheet is transported to the paper feeding unit, or passes through on the transporting surface, the sheet skews easily. As a result, sheet jamming occurs easily. Further, the toner image is transferred onto the sheet obliquely, and thereby the image is formed obliquely on the sheet easily.

The present invention has been made in consideration of the above-described conventional circumstances, and has an object to provide an image forming apparatus capable of well performing both transportation of a sheet and image formation on the sheet.

According to an aspect of the present teaching, there is provided an image forming apparatus configured to form an image on a sheet, including:

a sheet feeding unit configured to feed and transport a sheet;

a plurality of photoconductors configured to carry a toner image thereon and rotate while making a contact with the sheet being transported;

a transfer belt unit including a transfer belt of which surface faces each of the photoconductors and which is configured to circulate while transferring the toner image carried on each of the photoconductors onto the sheet being transported;

a first frame unit provided one end side in a width direction parallel to a rotational center of each of the photoconductors;

a second frame unit provided on the other end side in the width direction, so that each of the photoconductors, the sheet feeding unit, and the transfer belt unit are located between the second frame unit and the first frame unit; and a bridging member extending in the width direction and bridging the first frame unit and the second frame unit, wherein each of the photoconductors is held by the first frame unit and the second frame unit and is positioned with respect to the first frame unit based on one end thereof in the width direction, the transfer belt unit is biased to the one end side in the width direction to make a contact with the first frame unit and the bridging member, to thereby be positioned with respect to the first frame unit and the bridging member, and the sheet feeding unit makes a contact with at least two places of the bridging member, in the width direction from a perpendicular direction perpendicular to the width direction and parallel to the surface of the transfer belt, to thereby be positioned with respect to the bridging member.

In the image forming apparatus of the present teaching, the first frame unit is a positioning base for each of the photoconductors, and is also a positioning base for the transfer belt unit. Thereby, the transfer belt unit is highly accurately positioned with respect to each of the photoconductors via the first frame unit.

Further, in this image forming apparatus, the bridging member is a positioning base for the transfer belt unit, and is also a positioning base for the sheet feeding unit. Further, the sheet feeding unit abuts on at least two places, of the bridging member, in the width direction from the perpendicular direction, to thereby be prevented from being displaced so as to incline relative to the width direction. Therefore, it is possible to securely position the sheet feeding unit so that the sheet to be transported by the sheet feeding unit may not skew relative to the transfer belt unit. Accordingly, the sheet feeding unit is highly accurately positioned relative to each of the photoconductors and the transfer belt unit.

Thus, in the image forming apparatus of the present teaching, sheet jamming does not occur easily and an image is not easily formed obliquely on the sheet, and thus as a result, it is possible to well perform both the transportation of a sheet and the image formation on the sheet.

DETAILED DESCRIPTION OF THE PREFERRED EMBODIMENTS

Hereinafter, first and second embodiments in which the present teaching is substantiated will be explained with reference to the drawings.

First Embodiment

Figure 1:
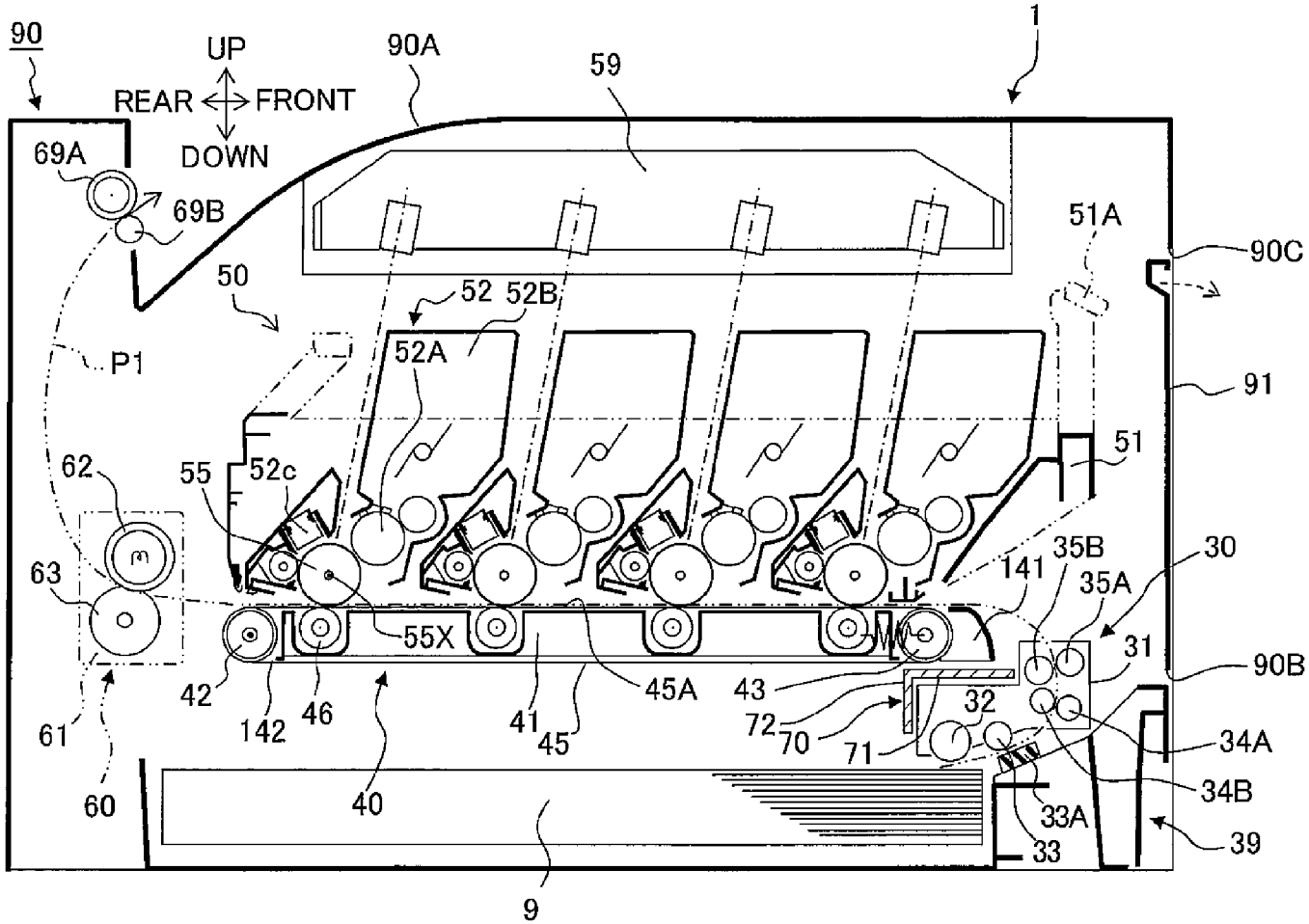
FIG. 1 is a schematic cross-sectional view of an image forming apparatus in the first embodiment.

As shown in FIG. 1, an image forming apparatus 1 in first embodiment is one example of a concrete aspect of an image forming apparatus of the present teaching. The image forming apparatus 1 is a color laser printer configured to form an image having a plurality of colors on a sheet 9 such as a paper or an OHP sheet by an electrophotographic method.

Figure 2:
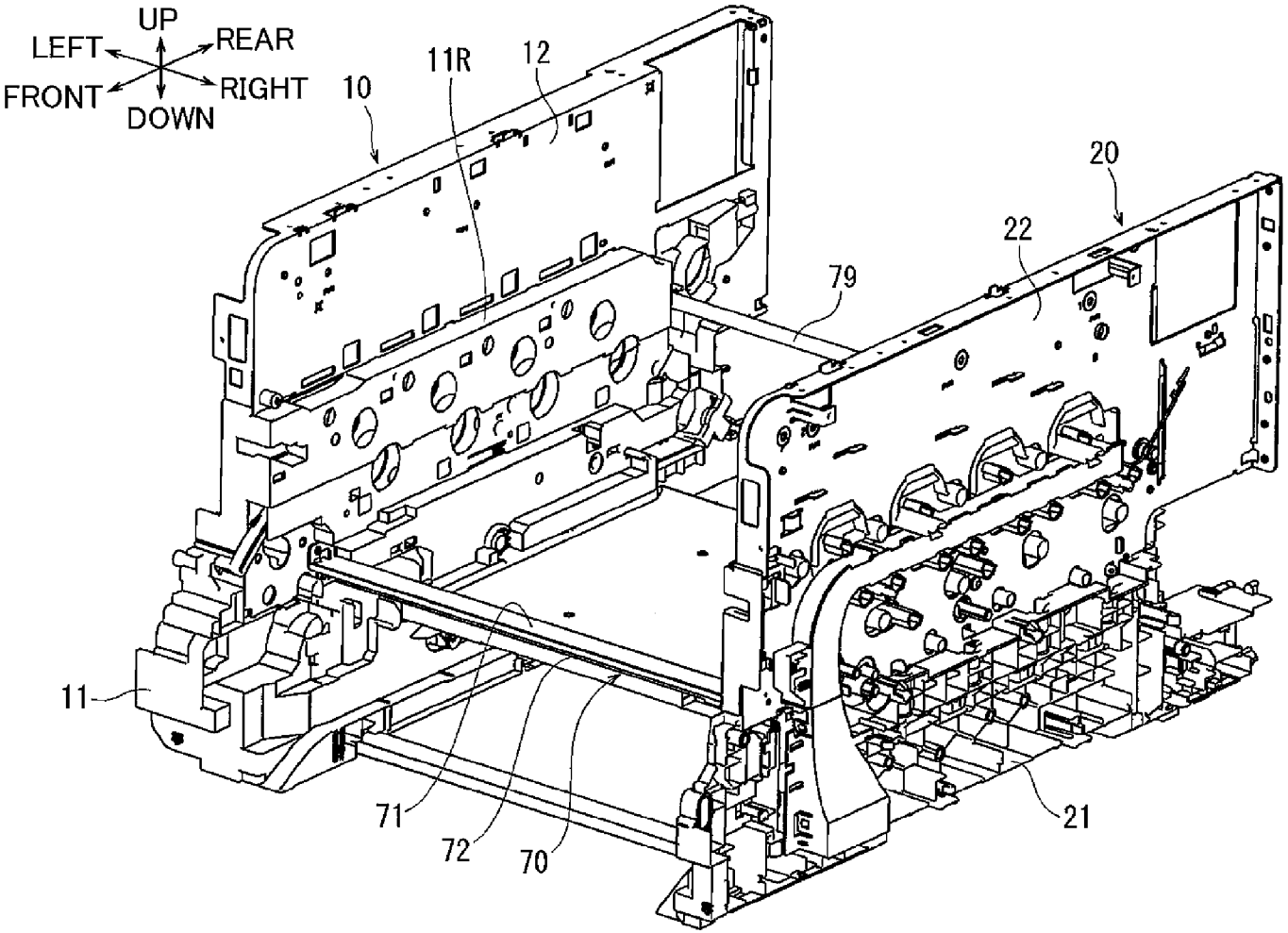
FIG. 2 is a perspective view showing first and second frame units and a bridging member according to the image forming apparatus in the first embodiment.

In FIG. 1, the right side of the paper sheet of FIG. 1 is defined as the front side of the apparatus, and the left side in the case when the apparatus is seen from the front side, namely the paper near side of FIG. 1 is defined as the left side. Based on these definitions, front and rear, right and left, and up and down directions are each shown. Then, respective directions shown in each of the drawings of and after FIG. 2 are all shown in a manner to correspond to the respective directions shown in FIG. 1. Hereinafter, based on FIG. 1 and so on, each component that the image forming apparatus 1 includes will be explained.

<Overall Constitution>

As shown in FIG. 1, the image forming apparatus 1 includes a box-shaped housing 90. On a top surface of the housing 90, a discharge tray 90A is formed so as to be recessed downward. On a lower side in a front surface of the housing 90, a first opening 90B is formed. A second opening 90C is formed in the front surface of the housing 90, at an area ranging from slightly below a middle portion to an upper side of the front surface of the housing 90.

Further, the image forming apparatus 1, as shown in FIG. 2, includes: a first frame unit 10; a second frame unit 20; and a bridging member 70. The first frame unit 10 is a flat plate-shaped member and extends along a left surface of the housing 90 from the inside. On the other hand, the second frame unit 20 is a flat plate-shaped member and extends along a right surface of the housing 90 from the inside. In FIG. 1, the first frame unit 10 is located on the paper near side, and the second frame unit 20 is located on the paper far side. Incidentally, in this example, the "flat plate shape" means a substantially flat plate shape, which also includes the case where a rib, a hole, a recess, a projection, and so on are formed.

As shown in FIG. 2, the first frame unit 10 is formed by a first resin frame 11, a first sheet metal frame 12, and so on being combined. A lower end edge side of the first resin frame 11 is made into a pedestal shape.

The second frame unit 20 is formed by a second resin frame 21, a second sheet metal frame 22, and so on being combined. A lower end edge side of the second resin frame 21 is also made into a pedestal shape, similarly to the first resin frame 11.

Figure 3:
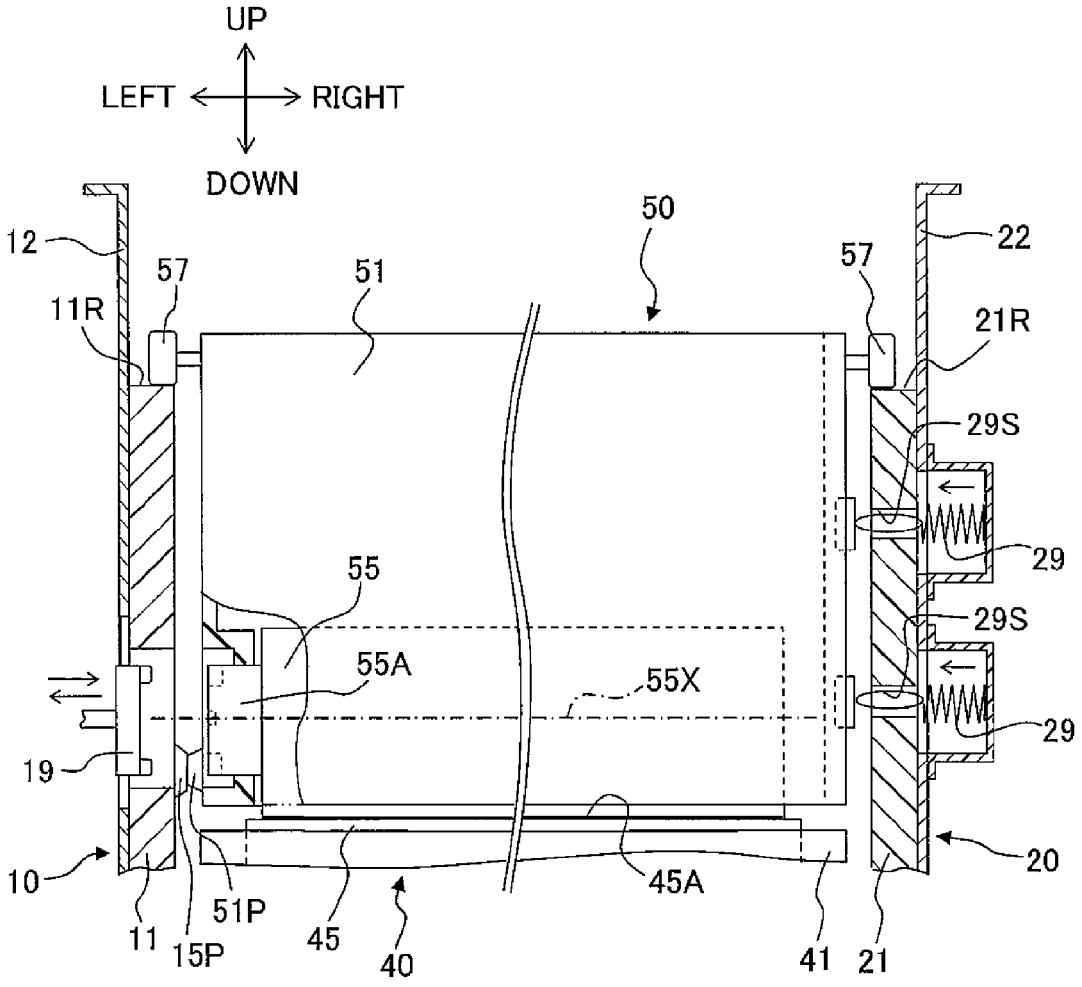
FIG. 3 is a schematic cross-sectional view showing the relative relationship of the first and second frame units, each photoconductor, and a transfer belt unit, according to the image forming apparatus in Example 1, when seen in a direction from the front to the rear.

As shown in FIG. 2 and FIG. 3, on an upper end edge side of the first resin frame 11, a rail 11R is formed to extend in the front and rear direction. As shown in FIG. 3, on an upper end edge side of the second resin frame 21 as well, a rail 21R similar to that of the first resin frame 11 is formed. The rail 11R and the rail 21R are formed to guide cam followers 57 of a later-described image forming section 50.

As shown in FIG. 2 and FIG. 3, the first sheet metal frame 12 is fastened to a left surface of the first resin frame 11 and extends upward rather than the rail 11R. The second sheet metal frame 22 is also fastened to a right surface of the second resin frame 22 and extends upward rather than the rail 21R.

As shown in FIG. 1 and FIG. 2, the bridging member 70 is a frame member made by a thin and long metal steel sheet being bent in an L shape in cross section. As shown in FIG. 2, the bridging member 70 extends in the right and left direction to bridge the first frame unit 10 and the second frame unit 20.

Figure 4:
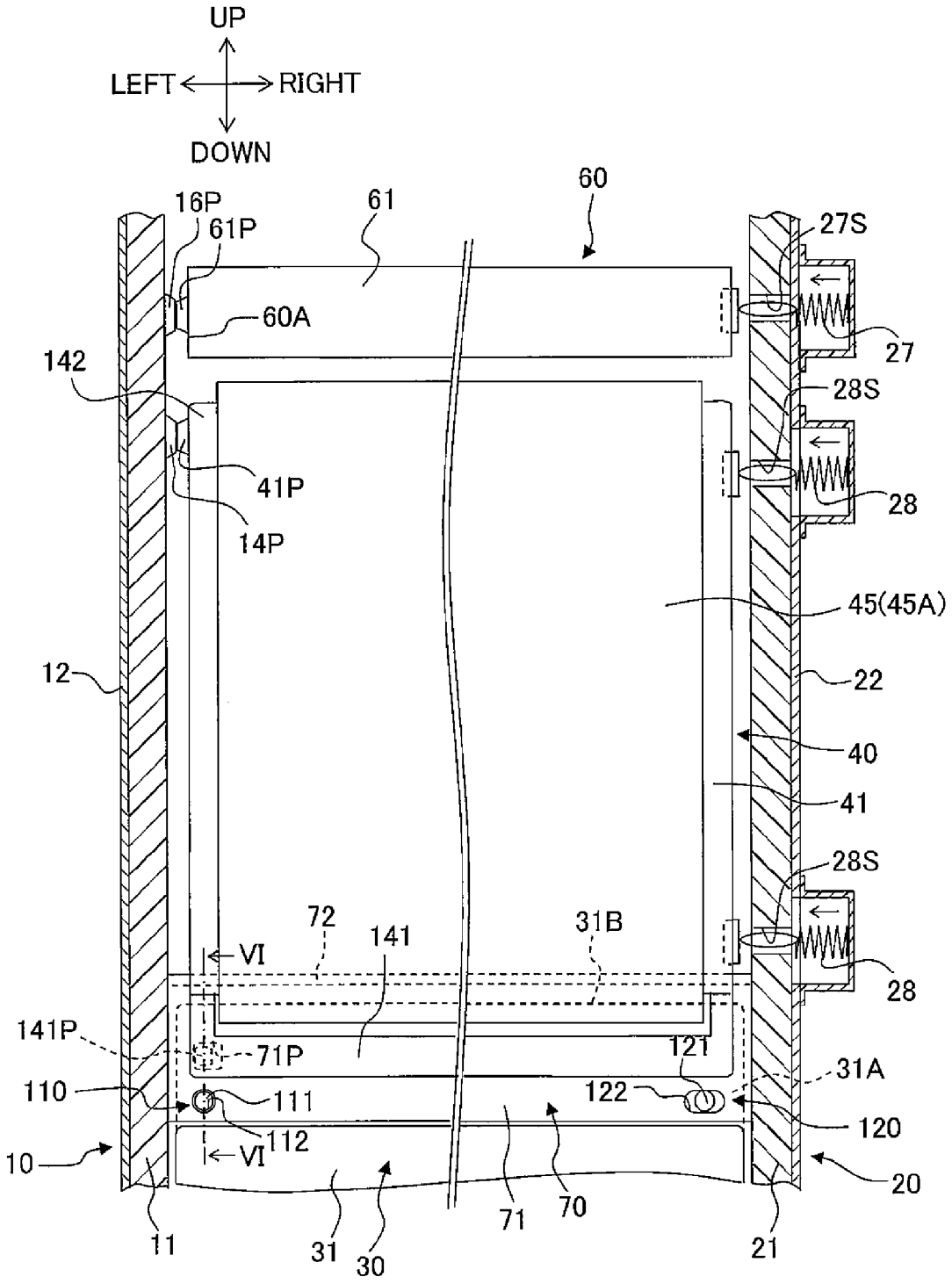
FIG. 4 is a schematic cross-sectional view showing the relative relationship of the first and second frame units, the bridging member, the transfer belt unit, a paper feeding unit, and a fuser, according to the image forming apparatus in the first embodiment, when seen in a direction from above to below.

More specifically, the bridging member 70 has a horizontal wall 71 and a vertical wall 72. As shown in FIG. 1, the horizontal wall 71 is located near an upper portion of the first opening 90B in the up and down direction. The vertical wall 72 is bent vertically from a rear end edge of the horizontal wall 71 to be hung down. Further, as shown in FIG. 2 and FIG. 4, a left end of the bridging member 70 is fastened to a front end edge side of the first resin frame 11. As shown in FIG. 4, a right end of the bridging member 70 is also fastened to a front end edge side of the second resin frame 21.

Incidentally, the first frame unit 10 and the second frame unit 20 are coupled not only by the bridging member 70 as described above but also by a plurality of coupling members extending in the right and left direction.

As shown in FIG. 1, at a lower portion in the housing 90, a sheet cassette 39 is provided. The sheet cassette 39 is located between the first frame unit 10 on the left and the second frame unit 20 on the right. The sheet cassette 39 has a box shape having an opened upper portion, and has a plurality of the sheets 9 housed therein in a stacked state. The sheet cassette 39 is inserted horizontally from a near side of the housing 90 through the first opening 90B to thereby be installed inside the housing 90, and by an action reverse to the above, the sheet cassette 39 is removed from the housing 90.

Figure 5:
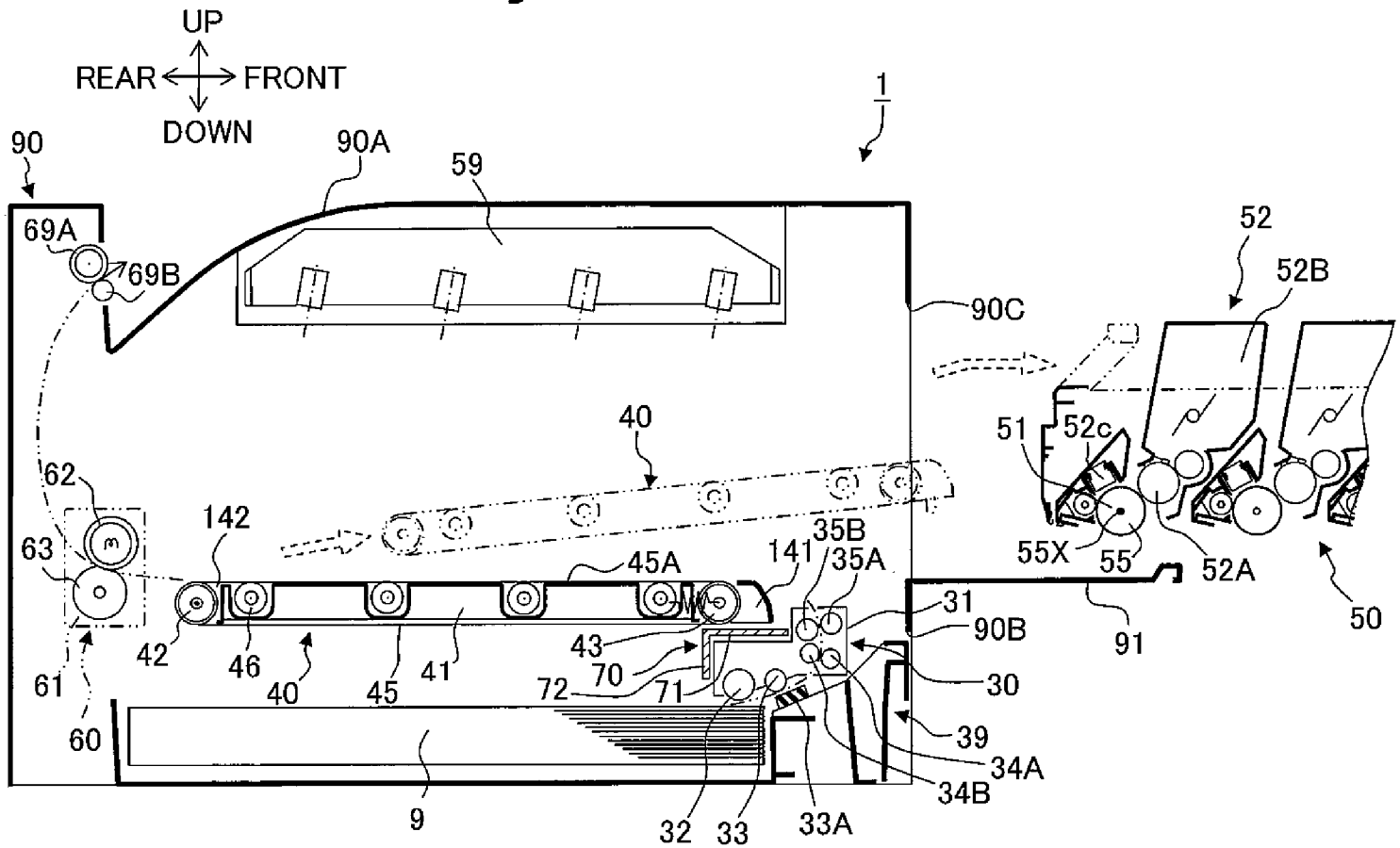
FIG. 5 is a schematic cross-sectional view showing an installing and removing action of an image forming part and the transfer belt unit according to the image forming apparatus in the first embodiment.

On the front surface of the housing 90, a front cover 91 being a flat plate-shaped member is provided. The front cover 91 closes the second opening 90C in a state of standing in the up and down direction. A lower end edge side of the front cover 91 is axially supported on a lower end edge side of the second opening 90C in a pivotable manner. Then, as shown in FIG. 5, an upper end edge side of the front cover 91 pivots forward to thereby open the second opening 90C.

As shown in FIG. 1, in the housing 90, a transporting path P1 is provided. The transporting path P1 proceeds to a front surface side of the housing 90 from a front end portion of the sheet cassette 39 and then makes a U-turn upward to thereby change its direction to the rear to bypass the bridging member 70. Next, the transporting path P1 horizontally proceeds to a rear surface side of the housing 90 and then makes a U-turn upward to thereby change its direction to the front and reaches the discharge tray 90A.

Further, the image forming apparatus 1 includes: a paper feeding unit 30; the image forming section 50; a scanner section 59; a transfer belt unit 40; a fuser or a fixing unit 60; and a discharge roller pair 69A and 69B. As shown in FIG. 3 and FIG. 4, the paper feeding unit 30, the image forming section 50, the transfer belt unit 40, and the fixing unit 60 are located between the first frame unit 10 on the left and the second frame unit 20 on the right.

The paper feeding unit 30 has: a paper feeding unit main body 31; a feed roller 32; a separating roller 33; a transporting roller pair 34A and 34B; and a resist roller pair 35A and 35B. The paper feeding unit main body 31 is a resin-made housing, and is located above the front end portion of the sheet cassette 39 and at the front of the bridging member 70. A rear side of the paper feeding unit main body 31 overlaps with the horizontal wall part 71 of the bridging member 70 from below.

The feed roller 32, the separating roller 33, the transporting roller pair 34A and 34B, and the resist roller pair 35A and 35B are rotatably housed in the paper feeding unit main body 31. Rotational centers of the feed roller 32, the separating roller 33, the transporting roller pair 34A and 34B, and the resist roller pair 35A and 35B extend in the right and left direction. The feed roller 32, the separating roller 33, the transporting roller pair 34A and 34B, and the resist roller pair 35A and 35B are arranged in this order from the most upstream side to the portion making a U-turn upward of the transporting path P1. On the sheet cassette 39, a separating pad 33A facing the separating roller 33 from below is provided.

The image forming section 50 is so-called a direct tandem type. The image forming section 50 includes: an image forming section main body 51 located above a horizontal portion of the transporting path P1; and four sets of photosensitive drums 55 and process cartridges 52 housed in the image forming section main body 51. The photosensitive drum 55 is one example of a "photoconductor" of the present teaching.

Four sets of the photosensitive drums 55 and the process cartridges 52 correspond to four color toners of black, yellow, magenta, and cyan, respectively.

Each of the photosensitive drums 55 has a cylindrical body extending in the right and left direction and is configured to carry a toner image on its surface. The photosensitive drums 55 are each aligned along the horizontal portion of the transporting path P1 from the front to the rear.

As shown in FIG. 3, each of the photosensitive drums 55 is supported on the image forming section main body 51 to be rotatable about a rotational center 55X extending in the right and left direction. The image forming section main body 51 positions each of the photosensitive drums 55 so that each of the photosensitive drums 55 may not be displaced in the right and left direction parallel to the rotational center 55X relative to the image forming part main body 51.

Here, the right and left direction parallel to the rotational center 55X of each of the photosensitive drums 55 is one example of a "width direction" of the present teaching. Further, in the housing 90, the left side where the first frame unit 10 is provided is one example of "one end side in the width direction" of the present teaching. Further, in the housing 90, the right side where the second frame unit 20 is provided is one example of the "other end side in the width direction" of the present teaching.

As shown in FIG. 1, the respective process cartridges 52 are held in the image forming section main body 51 so as to be located obliquely above the respective photosensitive drums 55. Each of the process cartridges 52 has a box shape extending in the right and left direction and has therein a developing roller 52A, a toner housing section 52B, a charger 52C, and so on.

The scanner section 59 is located above the image forming section 50. The scanner section 59 includes laser light sources, polygon mirrors, fθ lenses, reflectors, and so on. The scanner section 59 emits laser beams onto the respective photosensitive drums 55 from above.

The transfer belt unit 40 is located above the sheet cassette 39 and under the image forming section 50. The transfer belt unit 40 has; a transfer belt unit main body 41; a driving roller 42; a driven roller 43; a transfer belt 45; and four transfer rollers 46.

The transfer belt unit main body 41 is a flat frame-shaped frame member extending in the front and rear direction and the right and left direction. The driving roller 42 is rotatably supported on a rear end edge side of the transfer belt unit main body 41. The driven roller 43 is rotatably supported on a front end edge side of the transfer belt unit main body 41. Rotational centers of the driving roller 42 and the driven roller 43 extend in the right and left direction. The transfer belt 45 is an endless belt wound around the driving roller 42 and the driven roller 43. The respective transfer rollers 46 face the respective photosensitive drums 55 with the transfer belt 45 being interposed therebetween. The driving roller 42 rotates in synchronization with the respective photosensitive drums 55 and the like of the image forming section 50. Thereby, the driven roller 43 driven rotates and the transfer belt 45 circulates between the driving roller 42 and the driven roller 43.

On the transfer belt 45, a horizontal surface extending in the right and left direction and the front and rear direction along the horizontal portion of the transporting path P1 is called a transporting surface 45A. The transporting surface 45A faces the respective photosensitive drums 55 from below with the horizontal portion of the transporting path P1 being interposed therebetween. To the transporting surface 45A, negative voltage is applied by the respective transfer rollers 46.

As shown in FIG. 4, the transfer belt unit main body 41 includes: a first end portion 141 located on the side close to the bridging member 70 in the front and rear direction; and a second end portion 142 located on the side far from the bridging member 70 in the front and rear direction.

Figure 6:
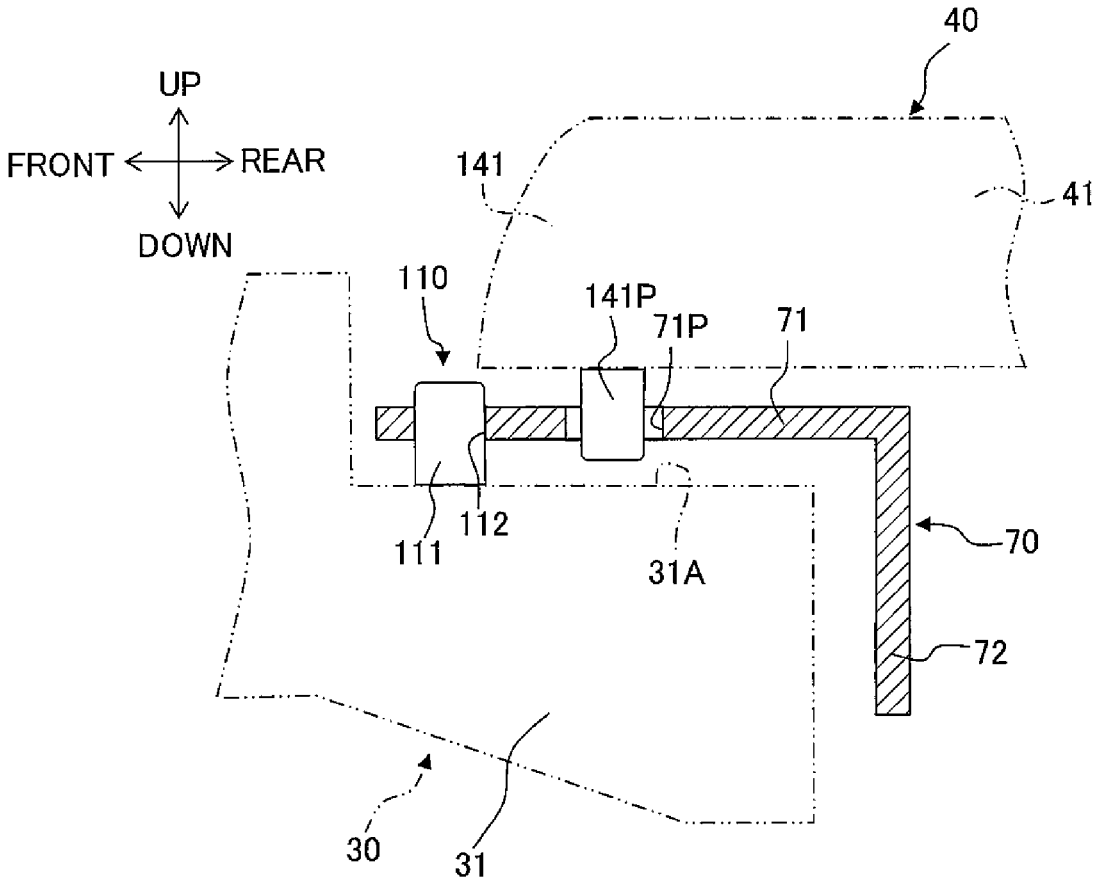
FIG. 6 is a partial cross-sectional view showing a cross section taken along VI-VI line in FIG. 4 according to the image forming apparatus in the first embodiment.

As shown in FIG. 4 and FIG. 6, the first end portion 141 extends forward rather than the transfer belt 45 and the driven roller 43 and extends in a beam shape in the right and left direction. Further, the first end portion 141 overlaps with the horizontal wall 71 of the bridging member 70 from above. In other words, the bridging member 70 is located between the paper feeding unit 30 and the transfer belt unit 40 in the front and rear direction. Here, the front and rear direction is one example of a "perpendicular direction perpendicular to the width direction and parallel to the transporting surface."

As shown in FIG. 1, the fixing unit 60 includes: a fixing unit main body 61; a heating roller 62; and a pressure roller 63. The fixing unit main body 61 is a resin-made housing, and is located below the rear U-turn portion in the transporting path P1 and near the second end portion 142. The heating roller 62 and the pressure roller 63 are rotatably housed in the fixing unit main body 61, and face each other with the transporting path P1 being interposed therebetween. Rotational centers of the heating roller 62 and the pressure roller 63 extend in the right and left direction.

The discharge roller pair 69A and 69B is located above the rear U-turn portion in the transporting path P1, namely on the most downstream side of the transporting path P1 and faces the discharge tray 90A.

<Image Forming Operation>

The image forming apparatus 1 forms an image on the sheet 9 housed in the sheet cassette 39 in the following manner. That is, when a control section (not shown) receives an instruction to start image forming, the control section starts to control the paper feeding unit 30, the image forming section 50, the scanner section 59, the transfer belt unit 40, the fixing unit 60, and the discharge roller pair 69A and 69B.

Then, in the paper feeding unit 30, the feed roller 32 and the separating roller 33 send out the sheet 9 housed in the sheet cassette 39 to the transporting path P1. On this occasion, when the plurality of sheets 9 are overlapped, the separating roller 33 and the separating pad 33A separate the sheets 9 one by one. Then, the transporting roller pair 34A and 34B and the resist roller pair 35A and 35B transport the sheet 9 to the horizontal portion of the transporting path P1.

Next, the sheet 9, while being adsorbed to the transporting surface 45A of the circulating transfer belt 45, is transported through the horizontal portion of the transporting path P1 and passes through under four sets of the photosensitive drums 55 and the process cartridges 52.

On this occasion, as the respective photosensitive drums 55 rotate, the surfaces of the respective photosensitive drums 55 are positively charged uniformly by the chargers 52*c*, and then are exposed by laser beams emitted by the scanner section 59. Thereby, the scanner section 59 forms an electrostatic latent image corresponding to the image that should be formed on the surfaces of the respective photosensitive drums 55. Next, by the developing roller 52A in each of the process cartridges 52, the color toner corresponding to the electrostatic latent image is supplied to the surface of the photosensitive drum 55 from the toner housing portion 52B to form a toner image. The photosensitive drum 55 rotates while making a contact with the sheet 9 which is transported while being adsorbed to the transporting surface 45A. Then the toner image is transferred onto the sheet 9 by acting the negative voltage applied to the transporting surface 45A.

Then, the fixing unit 60 heats and pressurizes the sheet 9 having passed through under each of the photosensitive drums 55 by the heating roller 62 and the pressure roller 63 to fix the toner image transferred onto the sheet 9. Thereafter, the sheet 9 is discharged onto the discharge tray 90A by the discharge roller pair 69A and 69B. In this manner, the image forming apparatus 1 finishes the image forming operation on the sheet 9.

<Positioning Constitution of Photosensitive Drums>

As shown in FIG. 2, at the rear of the rail 11R and the rail 21R, a positioning metal shaft body 79 is provided. The positioning metal shaft body 79 has a thin and long shape. The positioning metal shaft body 79 extends in the right and left direction to bridge the first frame unit 10 and the second frame unit 20.

As shown in FIG. 3, the image forming section main body 51 has the right and left paired cam followers 57. The both cam followers 57 are provided so as to project in a direction away from each other from upper portions of right and left surfaces of the image forming section main body 51.

The cam followers 57 both abut on the rail 11R and the rail 21R from above and a rear end portion of the image forming part 50 abuts on the positioning metal shaft body 79, and thereby the image forming section 50 is positioned in the up and down direction and the front and rear direction relative to the first frame unit 10 and the second frame unit 20. Thereby, each of the photosensitive drums 55 is held by the first frame unit 10 and the second frame unit 20 via the image forming section main body 51.

As shown in FIG. 3, in the second frame unit 20, a plurality of pieces of photosensitive drum biasing springs 29 is housed to be extendable and contractible in the right and left direction. Left ends of the photosensitive drum biasing springs 29 project from a left surface of the second frame unit 20 through slits 29S penetratingly provided in the second frame unit 20 to press the right surface of the image forming section main body 51 to the left.

On a lower portion of the left surface of the image forming section main body 51, a photosensitive drum positioning projection 51P is projectingly provided. On a right surface of the first frame unit 10, a photosensitive drum receiving portion 15P is projectingly provided at a position facing the photosensitive drum positioning projection 51P. The image forming section main body 51 is biased to the left by the photosensitive drum biasing springs 29 and the photosensitive drum positioning projection 51P abuts on the photosensitive drum receiving portion 15P, and thereby the image forming section main body 51 is positioned in the right and left direction relative to the first frame unit 10. Thereby, each of the photosensitive drums 55 is positioned in the right and left direction relative to the first frame unit 10 based on its own left end 55A via the image forming section main body 51.

In the first frame unit 10, a coupling 19 that transmits a driving force from a drive source (not shown) to each of the photosensitive drums 55 is provided. The coupling 19 moves forward and backward in the right and left direction to be engageable with or separable from each of the photosensitive drums 55.

As shown in FIG. 1, the image forming section main body 51 has a grip portion 51A provided so as to project upward from its front end portion. As shown in FIG. 5, when a user grips the grip portion 51A to pull it forward in a state where the front cover 91 is pivoted to open the second opening 90C, the cam followers 57 both roll on the rail 11R and the rail 21R and the image forming section 50 is pulled out to the outside of the housing 90 through the second opening 90C. It is also possible to remove the image forming section 50 in this state. Then, it is also possible to install the image forming section 50 in the housing 90 by an action reverse to the above-described action. On this occasion, the photosensitive drum biasing springs 29, the photosensitive drum positioning projection 51P, and the photosensitive drum receiving portion 15P act as described above, and thus each of the photosensitive drums 55 is positioned again in the right and left direction relative to the first frame unit 10 based on its own left end 55A.

<Positioning Constitution of Transfer Belt Unit>

The transfer belt unit 40 has part of the transfer belt unit main body 41 fit into the first frame unit 10 and the second frame unit 20 from above, to thereby be positioned in the up and down direction and the front and rear direction relative to the first frame unit 10 and the second frame unit 20, of which illustration and explanation are omitted.

As shown in FIG. 4, in the second frame unit 20, a plurality of pieces of transfer belt biasing springs 28 is housed to be extendable and contractible in the right and left direction. Left ends of the transfer belt biasing springs 28 project from the left surface of the second frame unit 20 through slits 28S penetratingly provided in the second frame unit 20 to press a right surface of the first end portion 141 and a right surface of the second end portion 142 of the transfer belt unit main body 41 to the left.

As shown in FIG. 4 and FIG. 6, the first end portion 141 of the transfer belt unit main body 41 includes a square-shaped projection 141P on a left end side of its own lower surface. The square-shaped projection 141P has a prismatic shape and projects downward. At a position, of the horizontal wall 71 of the bridging member 70, facing the square-shaped projection 141P, a square-shaped hole 71P is penetratingly formed. The square-shaped hole 71P is made larger than a cross-sectional shape of the square-shaped projection 141P. The first end portion 141 is biased to the left by the transfer belt biasing springs 28 and a left surface of the square-shaped projection 141P abuts on a left inner wall surface of the square-shaped hole 71P, and thereby the first end portion 141 is positioned in the right and left direction relative to the bridging member 70.

As shown in FIG. 4, on a left surface of the second end portion 142 of the transfer belt unit main body 41, a transfer belt positioning projection 41P is projectingly provided. On the right surface of the first frame unit 10, a transfer belt receiving portion 14P is projectingly provided at a position facing the transfer belt positioning projection 41P. The second end portion 142 is biased to the left by the transfer belt biasing springs 28 and the transfer belt positioning projection 41P abuts on the transfer belt receiving portion 14P, and thereby the second end portion 142 is positioned in the right and left direction relative to the first frame unit 10.

As above, the transfer belt unit 40 is positioned in the right and left direction relative to the first frame unit 10 and the bridging member 70.

As shown in FIG. 5, it is also possible for a user to grip the first end portion 141 and pull it forward while lifting it in a state where the front cover 91 is pivoted to open the second opening 90C and the image forming section 50 is removed. At this time, the transfer belt unit 40 is taken out to the outside of the housing 90 through the second opening 90C. Then, it is also possible to install the transfer belt unit 40 in the housing 90 by an action reverse to the above-described action. On this occasion, the transfer belt biasing springs 28, the square-shaped projection 141P, the square-shaped hole 71P, the transfer belt positioning projection 41P, and the transfer belt receiving portion 14P act as described above, and thus the transfer belt unit 40 is positioned again in the right and left direction relative to the first frame unit 10 and the bridging member 70.

<Positioning Constitution of Paper Feeding Unit>

The paper feeding unit 30 has part of the paper feeding unit main body 31 abut on the first frame unit 10 and the second frame unit 20 from above, to thereby be positioned in the up and down direction relative to the first frame unit 10 and the second frame unit 20, of which illustration and explanation are omitted.

Further, the paper feeding unit 30 is positioned in the front and rear direction and the right and left direction relative to the bridging member 70 in the following manner.

As shown in FIG. 4 and FIG. 6, between the paper feeding unit 30 and the bridging member 70, a first engaging portion 110 and a second engaging portion 120 are provided.

The first engaging portion 110 includes a first projection 111 located on a left end of the paper feeding unit 30 and a first recess 112 located on the left end of the bridging member 70.

The first projection 111 is provided on a horizontal facing surface 31A, on the rear side of the paper feeding unit main body 31, facing the horizontal wall 71 of the bridging member 70 from below. The first projection 111 is a cylindrical shaft projecting vertically upward from a left end of the horizontal facing surface 31A. Here, a direction from below to above is one example of a "direction perpendicular to the width direction and the perpendicular direction" of the present teaching.

The first recess 112 is formed at a position, of the horizontal wall 71, facing the first projection 111 so as to penetrate through the horizontal wall 71. The first recess 112 is a circular hole formed so as to engage with the first projection 111 without causing a backlash. When engaging with the first projection 111 as shown in FIG. 4 and FIG. 6, the first recess 112 restrains the first projection 111 from moving in the right and left direction and the front and rear direction.

The second engaging portion 120 includes: a second projection 121 located on a right end of the paper feeding unit 30; and a second recess 122 located on the right end of the bridging member 70.

The second projection 121 is also provided on the horizontal facing surface 31A similarly to the first projection 111. The second projection 121 is a cylindrical shaft projecting vertically upward from a right end of the horizontal facing surface 31A.

The second recess 122 is provided at a position, of the horizontal wall 71, facing the second projection 121 so as to penetrate through the horizontal wall 71. The second recess 122 is a hole thin and long in the right and left direction. An inner width, of the second recess 122, in the front and rear direction is narrow to such an extent that the second recess 122 engages with the second projection 121 without causing a backlash. On the other hand, an inner width, of the second recess 122, in the right and left direction is sufficiently longer than an outer diameter of the second projection 121. When engaging with the second projection part 121 as shown in FIG. 4, the second recess 122 restrains the second projection 121 from moving in the front and rear direction, but allows the second projection 121 to move in the right and left direction.

As above, the paper feeding unit 30 abuts on the left end and the right end of the bridging member 70 from the front and rear direction, to thereby be positioned in the front and rear direction relative to the bridging member 70. Then, the paper feeding unit 30, in a state of being positioned, is fastened to the first frame unit 10 and the second frame unit 20 by a fastening member such as a screw.

<Positioning Constitution of Fixing Unit>

The fixing unit 60 has part of the fixing unit main body 61 fit into the first frame unit 10 and the second frame unit 20 from above, to thereby be positioned in the up and down direction and the front and rear direction relative to the first frame unit 10 and the second frame unit 20, of which illustration and explanation are omitted.

As shown in FIG. 4, in the second frame unit 20, at least one fixing unit biasing spring 27 is housed to be extendable and contractible in the right and left direction. A left end of the fixing unit biasing spring 27 projects from the left surface of the second frame unit 20 through a slit 27S penetratingly provided in the second frame unit 20 to press a right surface of the fixing unit main body 61 to the left.

On a left surface of the fixing unit main body 61, a fixing unit positioning projection 61P is projectingly provided. On the right surface of the first frame unit 10, a fixing unit receiving portion 16P is projectingly provided at a position facing the fixing unit positioning projection 61P. The fixing unit main body 61 is biased to the left by the fixing unit biasing spring 27 and the fixing unit positioning projection 61P abuts on the fixing unit receiving portion 16P, and thereby the fixing unit main body 61 is positioned in the right and left direction relative to the first frame unit 10. Thereby, the fixing unit 60 is positioned relative to the first frame unit 10 based on its own left end 60A.

It is possible to remove the fixing unit 60 from the housing 90 by removing a rear cover of the housing 90, of which explanation is omitted.

<Operation and Effect>

In the image forming apparatus 1 in the first embodiment, as shown in FIG. 3, as for each of the photoconductors 55, the image forming section main body 51 is biased to the left by the photosensitive drum biasing springs 29, and the photosensitive drum positioning projection 51P abuts on the photosensitive drum receiving portion 15P. Thereby, each of the photoconductors 55 is positioned relative to the first frame unit 10 on the left based on its own left end 55A.

Further, as shown in FIG. 4, as for the transfer belt unit 40, the first end portion 141 is biased to the left by the transfer belt biasing springs 28, and the left surface of the square-shaped projection 141P abuts on the left inner wall surface of the square-shaped hole 71P. Thereby, the transfer belt unit 40 is positioned in the right and left direction relative to the bridging member 70. Further, the second end portion 142 is biased to the left by the transfer belt biasing springs 28, and the transfer belt positioning projection part 41P abuts on the transfer belt receiving portion 14P. Thereby, the transfer belt unit 40 is positioned in the right and left direction relative to the first frame unit 10.

That is, the first frame unit 10 is a positioning base for each of the photoconductors 55, and is also a positioning base for the transfer belt unit 40. Thereby, the transfer belt unit 40 is highly accurately positioned relative to each of the photoconductors 55 via the first frame unit 10, and thus the rotational centers of the driving roller 42 and the driven roller 43 are prevented from inclining relative to the rotational center 55X of each of the photosensitive drums 55.

Further, in this image forming apparatus 1, as shown in FIG. 4 and FIG. 6, the paper feeding unit 30 abuts on the left end and the right end of the bridging member 70 from the front and rear direction, to thereby be positioned in the front and rear direction relative to the bridging member 70. More specifically, at the left end of the bridging member 70, the first projection 111 and the first recess 112 of the first engaging portion 110 engage with each other, and at the right end of the bridging member 70, the second projection 121 and the second recess 122 of the second engaging portion 120 engage with each other, and thereby the paper feeding unit 30 is positioned in the front and rear direction relative to the bridging member 70.

That is, the bridging member 70 is a positioning base for the transfer belt unit 40, and is also a positioning base for the paper feeding unit 30. Further, by the first engaging portion 110 and the second engaging portion 120, the paper feeding unit 30 abuts on the left end and the right end of the bridging member 70 from the front and rear direction, to thus be securely prevented from being displaced so as to incline relative to the right and left direction. Therefore, the rotational centers of the feed roller 32 and so on constituting the paper feeding unit 30 are prevented from inclining relative to the rotational center 55X of each of the photosensitive drums 55, and the paper feeding unit 30 can be securely positioned so that the sheet 9 transported by the paper feeding unit 30 may not skew relative to the transfer belt unit 40. Accordingly, the paper feeding unit 30 is highly accurately positioned relative to each of the photoconductors 55 and the transfer belt unit 40.

Thus, in the image forming apparatus 1 in the first embodiment, jamming of the sheet 9 does not occur easily and an image is not easily formed obliquely on the sheet 9, and consequently, the transportation of the sheet 9 and the image formation on the sheet 9 can be both performed well.

Further, in this image forming apparatus 1, the first end portion 141 and the second end portion 142 widely separated from each other in the front and rear direction are biased to the left, and the first end portion 141 abuts on the bridging member 70 and the second end portion 142 abuts on the first frame unit 10. Therefore, it is easy to stabilize the posture of the transfer belt unit 40. As a result, it is possible to securely position the transfer belt unit 40 relative to each of the photoconductors 55 so that the transporting surface 45A of the transfer belt 45 may not incline relative to each of the photoconductors 55.

Further, in this image forming apparatus 1, the fixing unit 60 is positioned relative to the first frame unit 10 based on its own left end 60A. That is, the first frame unit 10 is a positioning base for the second end portion 142 of the transfer belt unit 40, and is also a positioning base for the fixing unit 60. Therefore, it is possible to highly accurately position the fixing unit 60 relative to the second end portion 142 of the transfer belt unit 40, and thus the rotational centers of the heating roller 62 and the pressure roller 63 are prevented from inclining relative to the rotational centers of the driving roller 42 and the driven roller 43. As a result, it is possible to prevent skewing of the sheet 9 that passes through on the transporting surface 45A of the transfer belt 45 to be transported to the fixing unit 60.

Further, in this image forming apparatus 1, by the first recess 112 to engage with the first projection without causing a backlash, the first projection 111 is restrained from moving in the right and left direction, and thus it is also possible to position the paper feeding unit 30 in the right and left direction.

Further, in this image forming apparatus 1, the first projection 111 and the first recess 112 greatly contributing to the positioning of the paper feeding unit 30 are located on the left close to the first frame unit 10, and thereby it is possible to reduce variations in relative positional relationship between the first frame unit 10 and the first projection 111 and the first recess 112. Therefore, in this image forming apparatus 1, it is possible to more highly accurately position the paper feeding unit 30 relative to each of the photoconductors 55 and the transfer belt unit 40.

Second Embodiment

Figure 7:
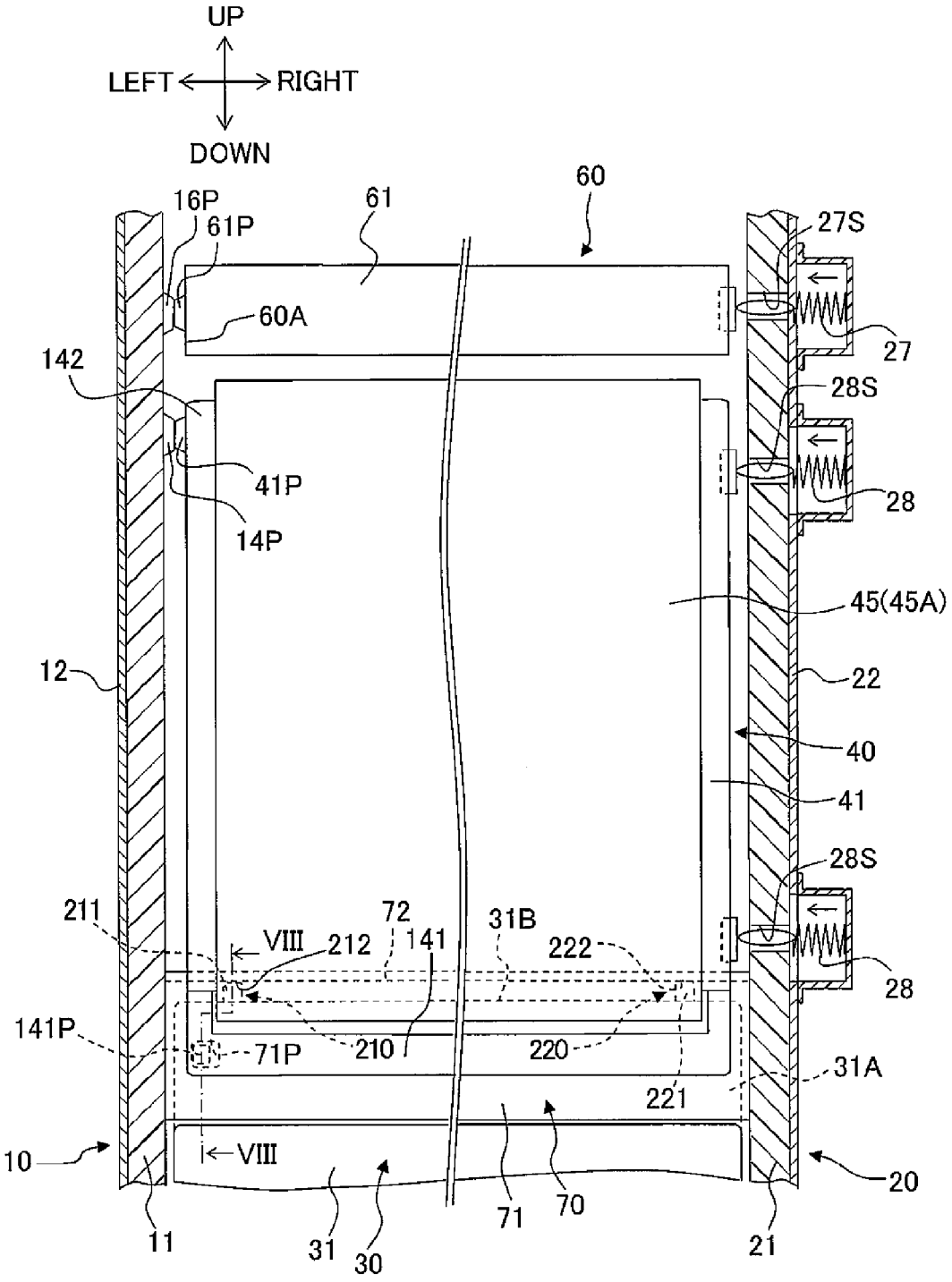
FIG. 7 is a schematic cross-sectional view showing the relative relationship of first and second frame units, a bridging member, a transfer belt unit, a paper feeding unit, and a fuser, according to an image forming apparatus in the second embodiment, when seen in a direction from above to below.
Figure 8:
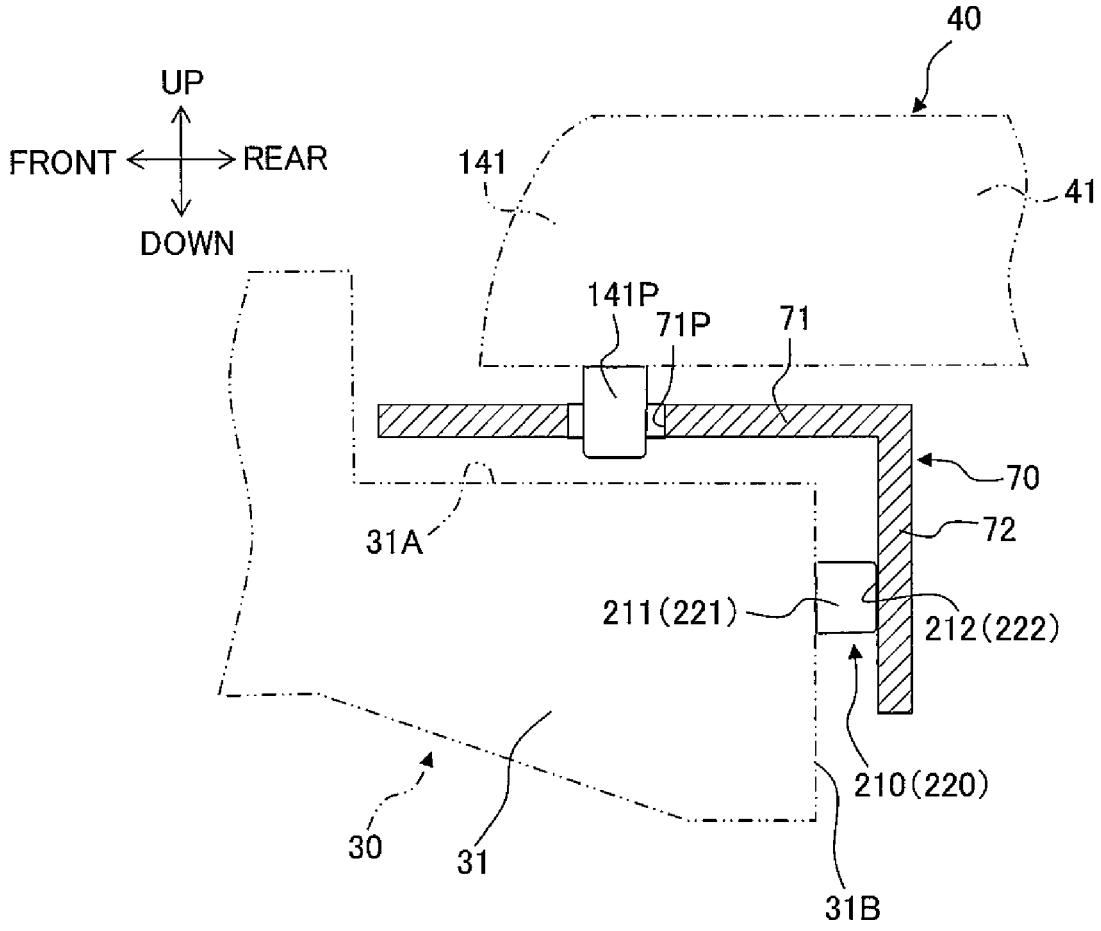
FIG. 8 is a partial cross-sectional view showing a cross section taken along VIII-VIII in FIG. 7 according to the image forming apparatus in second embodiment.

As shown in FIG. 7 and FIG. 8, an image forming apparatus in the second embodiment employs a pair of contact portions 210 and 220 in place of the first engaging portion 110 and the second engaging portion 120 in the image forming apparatus 1 in the first embodiment. Other components in the second embodiment are the same as those in the first embodiment. Therefore, the same components as those in the first embodiment are denoted by the same reference numerals and symbols, and their explanations are omitted.

In the image forming apparatus in the second embodiment, a pair of the contact portions 210 and 220 is provided between a paper feeding unit 30 and a bridging member 70.

The contact portion 210 includes: a projection 211 located on a left end of the paper feeding unit 30; and a stopper 212 located on a left end of the bridging member 70.

The projection 211 is provided on a vertical facing surface 31B, on a rear side of a paper feeding unit main body 31, facing a vertical wall 72 of the bridging member 70 from the front. The projection 211 is a cylindrical shaft body projecting rearward from a left end of the vertical facing surface 31B.

The stopper 212 is an area, of a front surface of the vertical wall 72, facing the projection 211. The stopper 212 restrains the projection 211 from moving rearward when the projection 211 abuts on the stopper 212 as shown in FIG. 7 and FIG. 8.

The contact portion 220 includes: a projection 221 located on a right end of the paper feeding unit 30; and a stopper 222 located on a right end of the bridging member 70. The projection 221 and the stopper 222 on the right have the same constitutions, except that their provided locations differ from those of the projection 211 and the stopper 212 on the right, and thus their explanations are omitted. Similarly to the stopper 212, the stopper 222 also restrains the projection 221 from moving rearward when the projection 221 abuts on the stopper 222 as shown in FIG. 7 and FIG. 8.

As above, by both the contact portions 210 and 220, the paper feeding unit 30 abuts on the left end and the right end of the bridging member 70 from the front to the rear to be positioned in the front and rear direction relative to the bridging member 70. Then, the paper feeding unit 30, in a state of being positioned, is fastened to a first frame unit 10 and a second frame unit 20 by a fastening mechanism such as a screw.

Such an image forming apparatus in the second embodiment can also exhibit the same effect and operation as those of the image forming apparatus 1 in the first embodiment.

Further, in this image forming apparatus, by both the contact portions 210 and 220, the paper feeding unit 30 is positioned in the front and rear direction relative to the bridging member 70 at the left end and the right end of the bridging member 70, to thus be securely prevented from being displaced so as to incline relative to the right and left direction.

In the foregoing, the present teaching has been explained based on the first and second embodiments, but it goes without saying that the present teaching is not limited to the first and second embodiments described above and can be modified appropriately without departing from the spirits of the present teaching to be applied.

In the first embodiment, the first projection 111 and the second projection 121 each are a cylindrical shaft body, the first recess 112 is a circular hole, and the second recess 122 is an elongated hole, but the present teaching is not limited to this configuration. The first projection 111 and the second projection 121 may each also be a prism, for example. The first recess may also be a circular hole, a square hole, a circular bottomed hole, a square bottomed hole, or the like, for example. Further, the second recess may also be an elongated hole, an elongated bottomed hole, or the like, for example.

The present teaching can be utilized for an image forming apparatus, a multifunction machine, and so on.

What is claimed is:

1. An image forming apparatus configured to form an image on a sheet, comprising:

a sheet feeding unit configured to feed and transport a sheet;

a plurality of photoconductors configured to carry a toner image thereon and rotate while making a contact with the sheet being transported;

a transfer belt unit including a transfer belt a surface of which faces each of the photoconductors and which is configured to circulate while transferring the toner image carried on each of the photoconductors onto the sheet being transported;

a first frame unit provided on one end side in a width direction parallel to a rotational center of each of the photoconductors;

a second frame unit provided on the other end side in the width direction, so that each of the photoconductors, the sheet feeding unit, and the transfer belt unit are located between the second frame unit and the first frame unit; and a bridging member extending in the width direction and bridging the first frame unit and the second frame unit, wherein each of the photoconductors is held by the first frame unit and the second frame unit and is positioned with respect to the first frame unit based on one end thereof in the width direction, the transfer belt unit is biased to the one end side in the width direction to make a contact with the first frame unit and the bridging member, to thereby be positioned with respect to the first frame unit and the bridging member, and the sheet feeding unit makes a contact with at least two places of the bridging member, in the width direction from a perpendicular direction perpendicular to the width direction and parallel to the surface of the transfer belt, to thereby be positioned with respect to the bridging member.

2. The image forming apparatus according to claim 1, wherein the bridging member is located between the sheet feeding unit and the transfer belt unit in the perpendicular direction, the transfer belt unit includes a first end portion and a second end portion located on a side farther from the bridging member in the perpendicular direction than the first end portion, the first end portion is biased to the one end side in the width direction to make a contact with the bridging member, to thereby be positioned with respect to the bridging member, and the second end portion is biased to the one end side in the width direction to make a contact with the first frame unit, to thereby be positioned with respect to the first frame unit.

3. The image forming apparatus according to claim 2, further comprising: a fixing unit located at a position near the second end portion and between the first frame unit and the second frame unit, and configured to heat and pressurize a sheet onto which a toner image is transferred by a transfer belt to fix the toner image to the sheet, wherein the fixing unit is positioned with respect to the first frame unit based on one end, of the fixing unit, in the width direction.

4. The image forming apparatus according to claim 1, wherein a first engaging portion located on one end in the width direction and a second engaging portion located on the other end in the width direction are provided between the sheet feeding unit and the bridging member, one of the first engaging portion and the second engaging portion includes a first projection projecting in a direction perpendicular to the width direction and the perpendicular direction and a first recess engaging with the first projection to restrain the first projection from moving in the width direction and the perpendicular direction, and the other of the first engaging portion and the second engaging portion includes a second projection projecting in a direction perpendicular to the width direction and the perpendicular direction and a second recess formed to engage with the second projection to restrain the second projection from moving in the perpendicular direction and formed to allow the second projection to move in the width direction.

5. The image forming apparatus according to claim 4, wherein the first engaging portion includes the first projection and the first recess, and the second engaging portion includes the second projection and the second recess.

6. The image forming apparatus according to claim 1, wherein a pair of contact portions located on one end and the other end in the width direction is provided between the sheet feeding unit and the bridging member, and each of the contact portions includes a projection projecting in the perpendicular direction and a stopper making a contact with the projection from the perpendicular direction.

* * * * *